US006190735B1

(12) United States Patent
Radwanski et al.

(10) Patent No.: US 6,190,735 B1
(45) **Date of Patent: *Feb. 20, 2001**

(54) PROCESS FOR TREATING A FIBROUS MATERIAL AND ARTICLE THEREOF

(75) Inventors: Fred Robert Radwanski; Henry Skoog, both of Roswell, GA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/276,629

(22) Filed: Mar. 25, 1999

Related U.S. Application Data

(63) Continuation of application No. 08/706,083, filed on Aug. 30, 1996, now Pat. No. 5,888,346.

(51) Int. Cl.[7] ..... B05D 3/12

(52) U.S. Cl. ..... 427/348; 427/353; 427/243; 162/108; 162/115

(58) Field of Search ..... 427/348, 353, 427/243; 8/636; 162/108, 115

(56) References Cited

U.S. PATENT DOCUMENTS

| | | | | |
|---|---|---|---|---|
| 3,117,905 | * | 1/1964 | Smith, II . | |
| 3,485,706 | * | 12/1969 | Evans . | |
| 3,706,064 | | 12/1972 | Lochner . | |
| 4,004,048 | * | 1/1977 | Jackson | 427/336 |
| 4,144,366 | | 3/1979 | Lewis . | |
| 4,190,695 | * | 2/1980 | Niederhauser . | |
| 4,202,852 | * | 5/1980 | Pauls et al. | 264/131 |

(List continued on next page.)

FOREIGN PATENT DOCUMENTS

| | | |
|---|---|---|
| 744462 | 6/1970 | (BE) . |
| 3021-438 | 12/1980 | (DE) . |
| 4106295 | 9/1992 | (DE) . |
| 0 483 816 | 5/1992 | (EP) . |
| 0 540 041 | 5/1993 | (EP) . |
| 423998 | 2/1935 | (GB) . |
| 62-170585 | 7/1987 | (JP) . |
| 63-175149 | 7/1988 | (JP) . |

(List continued on next page.)

OTHER PUBLICATIONS

Copy of Search Report for PCT/US97/12451 dated Nov. 7, 1997.

The *Application of Vat Dyes*, "Principles of Vat Dye Application", Chapter II, AATCC Monograph No. 2, Published by AATCC, 1953, pp. 11–53 (No month).

* cited by examiner

*Primary Examiner*—Shrive Beck
*Assistant Examiner*—Bret Chen
(74) *Attorney, Agent, or Firm*—Scott B. Garrison

(57) ABSTRACT

A process for treating a fibrous material which includes the steps of: 1) providing a liquid suspension composed of fibrous material; 2) intermixing the liquid suspension of fibrous material with a treatment over a time period $T_1$—wherein the treatment requires a period of time $T_R$ sufficient to treat the fibrous material; 3) depositing the liquid suspension of fibrous material and intermixed treatment onto a forming surface to form a layer and removing a substantial portion of the liquid, over a perod of time $T_2$; and 4) applying pressurized jets of a liquid to the layer of fibrous material to wash unused treatment from the fibrous material within a period of time $T_3$. Periods of time $T_1$, $T_2$ and $T_3$ are immediately consecutive and amount to a total period of time at least as great as $T_R$. Also disclosed is a hydraulically entangled structure composed of: 1) at least one layer a wet-laid nonwoven web containing fibrous cellulosic material; and 2) colorfast dye imparting color to the fibrous cellulosic material such that the fibrous cellulosic material is colorfast.

20 Claims, 1 Drawing Sheet

U.S. PATENT DOCUMENTS

| | | | | |
|---|---|---|---|---|
| 4,211,593 | | 7/1980 | Lochner . | |
| 4,340,692 | * | 7/1982 | Van Eenam | 525/329 |
| 4,379,799 | | 4/1983 | Holmes et al. . | |
| 4,398,915 | * | 8/1983 | Panto et al. | 8/543 |
| 4,515,656 | * | 5/1985 | Memeger, Jr. | 162/101 |
| 4,519,804 | | 5/1985 | Kato et al. . | |
| 4,740,214 | * | 4/1988 | McBride et al. | 8/561 |
| 4,741,075 | | 5/1988 | Taguchi et al. . | |
| 4,775,574 | * | 10/1988 | Hagy et al. . | |
| 4,808,467 | * | 2/1989 | Suskind et al. . | |
| 4,828,914 | | 5/1989 | Caldwell . | |
| 4,885,814 | * | 12/1989 | Von Der Eltz et al. | 8/149.1 |
| 4,902,564 | | 2/1990 | Israel et al. . | |
| 4,939,016 | * | 7/1990 | Radwanski et al. . | |
| 4,959,894 | | 10/1990 | Jeffers et al. . | |
| 4,960,630 | | 10/1990 | Greenway et al. . | |
| 4,986,882 | * | 1/1991 | Mackey et al. | 162/109 |
| 4,995,151 | | 2/1991 | Siegel et al. . | |
| 5,009,747 | * | 4/1991 | Viazmensky et al. . | |
| 5,023,130 | | 6/1991 | Simpson et al. . | |
| 5,045,210 | * | 9/1991 | Chen et al. | 210/679 |
| 5,106,457 | * | 4/1992 | Manning . | |
| 5,115,544 | * | 5/1992 | Widen | 28/105 |
| 5,137,600 | * | 8/1992 | Barnes et al. . | |
| 5,199,957 | * | 4/1993 | Pascoe | 8/478 |
| 5,328,759 | * | 7/1994 | McCormack et al. . | |
| 5,350,625 | * | 9/1994 | Peterson et al. | 428/219 |
| 5,389,202 | * | 2/1995 | Everhart et al. . | |
| 5,405,650 | | 4/1995 | Boulanger et al. . | |
| 5,459,912 | * | 10/1995 | Oathout . | |
| 5,486,381 | * | 1/1996 | Cleveland et al. . | |
| 5,492,550 | * | 2/1996 | Krishnan et al. . | |
| 5,496,603 | * | 3/1996 | Reidel et al. . | |
| 5,573,841 | * | 11/1996 | Adam et al. | 428/219 |
| 5,609,950 | | 3/1997 | Kampl et al. . | |
| 5,641,563 | * | 6/1997 | Truong et al. . | |
| 5,656,333 | * | 8/1997 | Truong et al. . | |
| 5,725,601 | * | 3/1998 | Tajiri et al. | 8/120 |
| 5,766,269 | * | 6/1998 | Berenguer et al. | 8/652 |
| 5,830,315 | * | 11/1998 | Mitchell et al. | 162/500 |
| 5,888,346 | * | 3/1999 | Radwanski et al. | 162/115 |
| 6,022,447 | * | 2/2000 | Radwanski et al. | 162/115 |

FOREIGN PATENT DOCUMENTS

| | | | |
|---|---|---|---|
| 1-139851 | | 6/1989 | (JP) . |
| 89/09850 | | 10/1989 | (WO) . |
| 92/08834 | * | 5/1992 | (WO) . |

PROCESS FOR TREATING A FIBROUS MATERIAL AND ARTICLE THEREOF

This application is a continuation of application Ser. No. 08/706,083 now U.S. Pat. No. 5,888,346, which has been withdrawn, entitled Process for Treating a Fibrous Material and Article Thereof and filed in the U.S. Patent and Trademark Office on Aug. 30, 1996. The entirety of application Ser. No. 08/706,083 is hereby incorporated by reference.

FIELD OF THE INVENTION

This invention relates to a method of treating a fibrous material. The invention also relates to a cellulosic material having durable color.

BACKGROUND OF THE INVENTION

A demand exists for cellulose fiber containing nonwoven materials that are colored, have textile aesthetics and performance, and remain fast under harsh chemical and abrasive use. It is highly desirable for such nonwoven materials to be laundrable and durable. It is also desirable for such substrates to be lightfast.

These nonwoven materials can be used to replace traditional textiles in applications including, but not limited to, wipers, wearing apparel, equipment protection, and bedding. Such products are used in a wide range of industries including: manufacturing, medical, printing, spray paint, garment and food services.

Insoluble colorant pigments are used to color cellulose fiber containing nonwoven materials. These pigments are generally inorganic or contain a synthetic organic base. A fixing agent is typically used to improve fastness because these colorant pigments are insoluble in the application medium and do not readily migrate into cellulose fibers or fix onto them. Useful fixing agents include alum, caseins, starches, acrylics, rosin sizes, polyvinyl alcohols, and cationic colorant fixatives. Generally speaking, these fixatives only modestly improve durability.

Soft polymeric adhesive binders or resins are also used as fixing agents. They improve durability by encapsulating and binding the insoluble pigment to fiber surfaces. Binders and resins have limited use because they are a surface treatment and generally have only moderate fastness. Deeper shades of color require excess pigment and binder or resin that tend to rub off or crock. Moreover, high levels of pigment act as fillers and can physically weaken a sheet. Binders or resins also stiffen nonwoven materials and imcair textile-like aesthetics while often negatively impacting liquid distribution and absorbency properties.

Binders and resins are often soluble in many common volatile and semi-volatile commercial and industrial liquids and solvents and could leach from the nonwoven material leaving undesirable residues and streaks. When used on hot surfaces or at high temperature, binder or resin on colored nonwoven materials may migrate, soften, degrade, alter the nonwoven material properties and/or leave residues. Another disadvantage of binder and resin coloring systems is that they are often added to dried sheets using size presses, saturation techniques or printing operations and then again dried. Many binders are also applied as a secondary process off-line to the basesheet production which also increases costs.

Dye colorants are also used to color cellulose fibers and cellulose fiber containing nonwoven materials. Dyestuffs, dye colorants, or dyes are generally categorized into numerous classes according to application. These categories include: basic, acid, direct (including cationic directs), mordant, azoic, disperse, reactive, sulfur and vat dyes. These dyes have a wide range of cost, dyeing properties and fastness. In addition, the method of applying such dyes varies widely from simple introduction to suspended stocks and webs to multi-stage chemical processes.

Dyes are physically or chemically bonded to fiber to provide durable color. They are bonded typically by one or more forces including physical entrapment, hydrogen bonding, van der Waals forces, coordinately bonded, ionic forces or covalent bonds. Generally speaking, dyes are usually fast or permanent in only some aspects or under certain conditions.

It is desirable for dye colorants to be resistant to light and water. It is also desirable for a dye colorant to withstand other influences encountered in commercial and industrial applications of cellulose fiber containing nonwoven materials. These include, but are not limited to, bleaches and detergents used during laundering and soaking for stain removal; cleaners including acids such as vinegar and bases; and a large list of industrial chemicals including oils, cutting oils, and solvents having a wide range of dipole moments such as: acetone, methylene chloride, 1,1,1 trichloroethane and various alcohols, ketones, benzene, naphthalene and mineral spirits.

Generally speaking, basic dyes have poor light fastness and are susceptible to uneven coloring of cellulose fibers (e.g., paper fibers). Acid dyes are readily susceptible to water bleeding because of their low affinity to cellulose fibers. Direct or substantive dyes will color cellulose fibers without the use of dyeing assistants or mordants. However, they tend to lack the overall chemical fastness needed even with the use of mordanting, cationic fixing agents, formaldehydes or coupling compounds. Direct dyes lack overall fastness since the forces binding them are easily broken.

Generally speaking, mordant dyes have no affinity for cellulose fibers and require use of a metallic oxide treatment for good fastness properties. Azoic dyes require coupling of two dye components onto the fiber but lack overall chemical fast requirements and are normally limited to only a few cellulosic applications. Disperse dyes are typically used to color hydrophobic fibers and are fine-size organic compounds with limited solubility and crock resistance.

Reactive dyes can be described as acid, basic or mordant dye with an attached reactive group that is capable of covalent bonding to a cellulose fiber.

Good fastness is typically obtained by converting soluble compounds into relatively insoluble compounds within the fiber. Sulfur and vat dyes are insoluble and therefore must be chemically modified before coloring fiber. With these dyes, the insoluble dye is iirst reduced to the soluble leuco compound and after integration into fiber, oxidized back to the insoluble form using typically sodium sulfide for sulfur dyes and sodium perborate for vat dyes.

Cellulose fibers may be dyed utilizing a variety of methods ranging from dyeing individual fibers to consolidated webs and by dyeing at points within the nonwoven web construction process. Exemplary methods include beater or stock coloring within the slush or slurry to dyeing webs by padding, jig dipping, dyebaths, squeezing, extraction operations, foam curtain dyeing and printing. Many of these methods are off-line textile finishing processes.

Specialized pad-batch, pad-thermofix, and pad-steam methods and modified versions for continuous operations with numerous steps have also been developed for reactive dyes by padding the web with dye solution. The web is then either stored for extended reaction times in a vapor tight enclosure or steam heated, further padded, and afterwards the web is washed of spent chemical.

Low speed continuous pad-jig methods and pad-steam methods are often employed for permanent dyeing of webs with vat dyes. Suitable reaction times have been achieved especially at elevated temperatures. After chemical dyeing using reactive and vat dyes, a washing step(s) is added to remove unreacted exhausted chemicals since the reaction is not 100% complete. More permanent colorants generally require several chemical process steps and extended reaction times.

While reactive dyes, vat dyes and sulfur dyes appear desirable for use with cellulose fibers, application of these dyes requires more than one process step and is often hampered by slow line speeds needed to achieve adequate reaction times.

Accordingly a need exists for a simple process for applying reactive dyes, vat dyes and sulfur dyes to cellulose fibers and to cellulose fiber containing nonwoven materials to produce durable coloration. This need extends to a continuous or one-step process for applying such dyes to the described substrates so they are colorfast. This need also extends to a process for applying such dyes that is suitable for high-speed manufacturing processes. There is also a need for colorfast cellulose fibers, nonwoven materials containing colorfast cellulose fibers, and colorfast nonwoven materials that include cellulose fibers that are prepared in a simple, one-step process.

Definitions

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing, spunbonding, wet-forming and various bonded carded web processes.

The term "pulp" as used herein refers to cellulosic fibers from natural sources such as woody and non-woody plants. Woody plants include, for example, deciduous and coniferous trees. Non-woody plants include, for example, cotton, flax, esparto grass, milkweed, straw, jute hemp, and bagasse.

The terms "colorfast" and/or "fastness" refer to the extent that color will fade or change upon exposure to an agent such as, for example, sunlight, reactive gases, chemicals, solvents and the like. Colorfastness or fastness can be measured by standard test methods such as, for example, AATCC Test Method 3-1989.

The terms "crock" or "crockfast" refers to the extent that color may be transferred from the surface of a dyed fabric to another surface by rubbing. Crock testing may be carried out utilizing standard test procedures and equipment such as, for example, an AATCC Crockmeter Model CM.5, available from Atlas Electric Devices Co. Chicago, Ill.

As used herein, the term "sheet" refers to a material that can be a woven fabric, knit fabric, nonwoven fabric or film-like material (e.g., an apertured film-like material).

As used herein, the term "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spun-bonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein, the term "conjugate spun filaments" refers to spun filaments and/or fibers composed of multiple filamentary or fibril elements. Exemplary conjugate filaments may have a sheath/core configuration (i.e., a core portion substantially or completely enveloped by one or more sheaths) and/or side-by-side strands (i.e., filaments) configuration (i.e., multiple filaments/fibers attached along a common interface). Generally speaking, the different elements making up the conjugate filament (e.g., the core portion, the sheath portion, and/or the side-by-side filaments) are formed of different polymers and spun using processes such as, for example, melt-spinning processes, solvent spinning processes and the like. Desirably, the conjugate spun filaments are formed from thermoplastic polymers utilizing a melt-spinning process such as a spunbond process adapted to produce conjugate spunbond filaments.

As used herein, the term "hydraulic entangling" refers to a method of mechanically bonding a fibrous material by treatment with pressurized jets of a liquid. Exemplary hydraulic entangling processes are disclosed at, for example, U.S. Pat. No. 3,485,706 to Evans et al.; U.S. Pat. No. 4,939,016 to Radwanski et al.; and U.S. Pat. No. 5,389,202 to Everhart et al.

As used herein, the term "hydraulic needling" refers to a method of loosening, opening up, rearranging and/or modifying a relatively compact network of fibrous material utilizing pressurized jets of a liquid. An exemplary hydraulic needling process is disclosed at, for example, U.S. Pat. No. 5,137,600 to Barnes et al.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The problems described above are addressed by the present invention which is directed to a process for treating a fibrous material. The process includes the steps of: 1) providing a liquid suspension composed of fibrous material; 2) intermixing the liquid suspension of fibrous material with a treatment over a time period $T_1$—wherein the treatment requires a period of time $T_R$ to treat the fibrous material; 3) depositing the liquid suspension of fibrous material and intermixed treatment onto a forming surface to form a layer and removing a substantial portion of the liquid, over a period of time $T_2$; and 4) applying pressurized jets of a liquid to the layer of fibrous material to wash unused treatment from the fibrous material within a period of time $T_3$. According to the invention, the periods of time $T_1$, $T_2$ and $T_3$ are immediately consecutive and amount to a total period of time at least as great as $T_R$.

The liquid suspension of fibrous material may be an aqueous suspension and may contain fibrous material such as, for example, polyester fibers and/or cellulose containing fibers. Desirably, the cellulosic fibers are hydrated cellulosic fibers. Generally speaking, the fibrous cellulosic material can be pulp fibers, synthetic cellulose fibers, modified cellulose fibers and combinations thereof. The fibrous cellulosic material may include particulates, non-cellulosic fibrous materials and/or other materials.

According to the invention, the treatment is desirably a chemically reactive treatment. The chemically reactive treatment may be one or more of reactive dyes, vat dyes and sulfur dyes.

In an aspect of the invention, the deposited layer of fibrous material and intermixed treatment may be formed into a web or sheet-like structure. This web may be smooth or may have patterns, striations, bumps, ridges or the like.

The forming surface which receives the deposited layer may include at least one layer of sheet material between the forming surface and the deposited layer of fibrous material and intermixed treatment. This sheet material can be one or more nonwoven webs, textile webs, scrim materials, plexifilimentary films, tows and combinations of the same. For example, the nonwoven webs may be one or more melt-blown webs, spunbond webs, bonded carded webs, fibrous batts, air-laid webs, wet-laid webs, coformed webs and combinations thereof. Additional layers of sheet material may be positioned over the deposited layer of fibrous material. According to an embodiment of the invention, the deposited layer of fibrous material may be sandwiched between two layers of sheet material. Alternatively and/or additionally, the web may be formed separately and then joined to another layer of material (e.g., a spunbond nonwoven web or the like) prior to treatment with pressurized jets of a liquid.

According to the invention, the applied pressurized jets of liquid used to wash unused treatment from the fibrous material may also be sufficient to hydraulically entangle the fibrous material. Hydraulic entangling may be limited to only the fibrous material or may involve the fibrous material and one or more layers of sheet material described above. Alternatively and/or additionally, the applied pressurized jets of liquid used to wash unused treatment from the fibrous material may also be sufficient to hydraulically needle the fibrous material. Hydraulic needling may be limited to only the fibrous material or may involve the fibrous material and one or more layers of sheet material described above.

The process of the present invention may include one or more (e.g., at least one) secondary or post treatment step(s). Exemplary post treatment steps include additional washing steps, drying steps, embossing steps, perforating steps, adding a fixative, curing agent, mechanical softening steps, slitting, winding and the like.

The present invention encompasses a product produced by the process described above. The product is a web or sheet-like material composed of or including treated fibrous material. For example, the product may be a web composed of or including colorfast fibrous cellulosic material.

In an aspect of the invention, $T_R$ may range from a few minutes to an hour or more. $T_1$, $T_2$ and $T_3$ may each individually range from less than a second to several minutes to an hour or more as long as they are immediately consecutive (i.e., with no significant time gaps, down time or off-line time between at least $T_2$ and $T_3$) and amount to a total period of time at least as great as $T_R$.

In one embodiment, the present invention encompasses a process of forming a web of treated fibrous cellulosic material. The process includes the steps of: 1) providing an aqueous suspension including hydrated fibrous cellulosic material; 2) intermixing the aqueous suspension of hydrated fibrous cellulosic material with a reactive treatment over a time period $T_1$, the treatment requiring a period of time $T_R$ sufficient to treat the fibrous cellulosic material; 3) depositing the aqueous suspension of hydrated fibrous cellulosic material and intermixed reactive treatment onto a surface to form a web and removing a substantial portion of the aqueous liquid, over a period of time $T_2$; and 3) applying pressurized jets of a liquid to the web to wash unused reactive treatment from the web within a period of time $T_3$; wherein $T_1$, $T_2$ and $T_3$ are immediately consecutive and amount to a period of time at least as great as $T_R$.

Desirably, the chemically reactive treatment is selected from reactive dyes, vat dyes and sulfur dyes. If a vat dye is used, the process is practiced such that the vat dye is reduced to its soluble leuco form and subsequently converted to an insoluble form during the period of time $T_R$.

The process may be practiced such that the forming surface includes at least one layer of sheet material between the forming surface and the deposited layer of fibrous material and intermixed treatment. Alternatively and/or additionally, the deposited layer of fibrous material may be formed separately and then joined to one or more layers of the same or another material (e.g., a spunbond nonwoven web or the like) prior to treatment with pressurized jets of a liquid. The fibrous cellulosic material may be one or more of pulp fibers, synthetic cellulose fibers and combinations thereof.

According to the invention, the jets of a liquid may be adapted to hydraulically entangle the web. Alternatively, the jets of a liquid may be adapted to hydraulically needle the web. Of course, the process of present invention may further include at least one post treatment steps.

Another embodiment of the invention encompasses a process for forming a web of colorfast fibrous cellulosic material. The process includes the steps of: 1) providing an aqueous suspension comprising hydrated fibrous cellulosic material; 2) intermixing the aqueous suspension of hydrated fibrous cellulosic material with a reactive treatment over a time period $T_1$, said treatment selected from reactive dyes, vat dyes and sulfur dyes requiring a period of time $T_R$ sufficient to treat the fibrous cellulosic material; 3) depositing the aqueous suspension of hydrated fibrous cellulosic material and intermixed reactive treatment onto a surface to form a web and removing a substantial portion of the aquaeous liquid, over a period of time $T_2$; and 3) applying pressurized jets of a liquid to the web to wash unused reactive treatment from the web within a period of time $T_3$; wherein $T_1$, $T_2$ and $T_3$ are immediately consecutive and amount to a period of time at least s great as $T_R$.

If a vat dye is used, the process is practiced such that the vat dye is reduced to its soluble leuco form and subsequently converted to an insoluble form during the period of time $T_R$.

The forming surface may include at least one layer of sheet material between the forming surface and the deposited layer of fibrous cellulosic material and intermixed reactive treatment. Alternatively and/or additionally, the deposited layer of fibrous cellulosic material may be formed separately and then joined to one or more layers of the same or another materiel (e.g., a spunbond nonwoven web or the like) prior to treatment with pressurized jets of a liquid. The fibrous cellulosic material may be one or more of pulp fibers, synthetic cellulose fibers, modified cellulose fibers and combinations thereof.

According to the invention, the pressurized jets of a liquid may be adapted to hydraulically entangle the web. Alternatively, the pressurized jets of a liquid may be adapted to hydraulically needle the web. Of course, the process of present invention may further include at least one post treatment step.

The present invention also encompasses a hydraulically entangled structure composed of colorfast, fibrous material.

The structure is composed of: 1) at least one layer a wet-laid nonwoven web containing fibrous cellulosic material; and 2) colorfast dye imparting color to the fibrous cellulosic material such that the fibrous cellulosic material is colorfast.

The wet-laid nonwoven web component of the hydraulically entangled structure may include a layer of sheet material. The sheet material may be selected from spunbond webs, meltblown webs, bonded carded webs, woven fabrics, knit fabrics, scrims and combinations thereof. Alternatively and/or additionally, the hydraulically entangled structure of colorfast, fibrous material may include a matrix of adhesive material. The adhesive material may be a resin or glue. The colorfast dye component of the hydraulically entangled structure may be selected from reactive dyes, vat dyes and sulfur dyes.

The present invention also encompasses a hydraulically needled structure composed of colorfast, fibrous material. The structure is composed of: 1) at least one layer a wet-laid nonwoven web containing fibrous cellulosic material; and 2) colorfast dye imparting color to the fibrous cellulosic material such that the fibrous cellulosic material is colorfast. The hydraulically needled structure of colorfast, fibrous material may include a matrix of adhesive material. The adhesive material may be a resin or glue. The colorfast dye component of the hydraulically needled structure may be selected from reactive dyes, vat dyes and sulfur dyes.

DETAILED DESCRIPTION OF THE INVENTION

Figure 1:
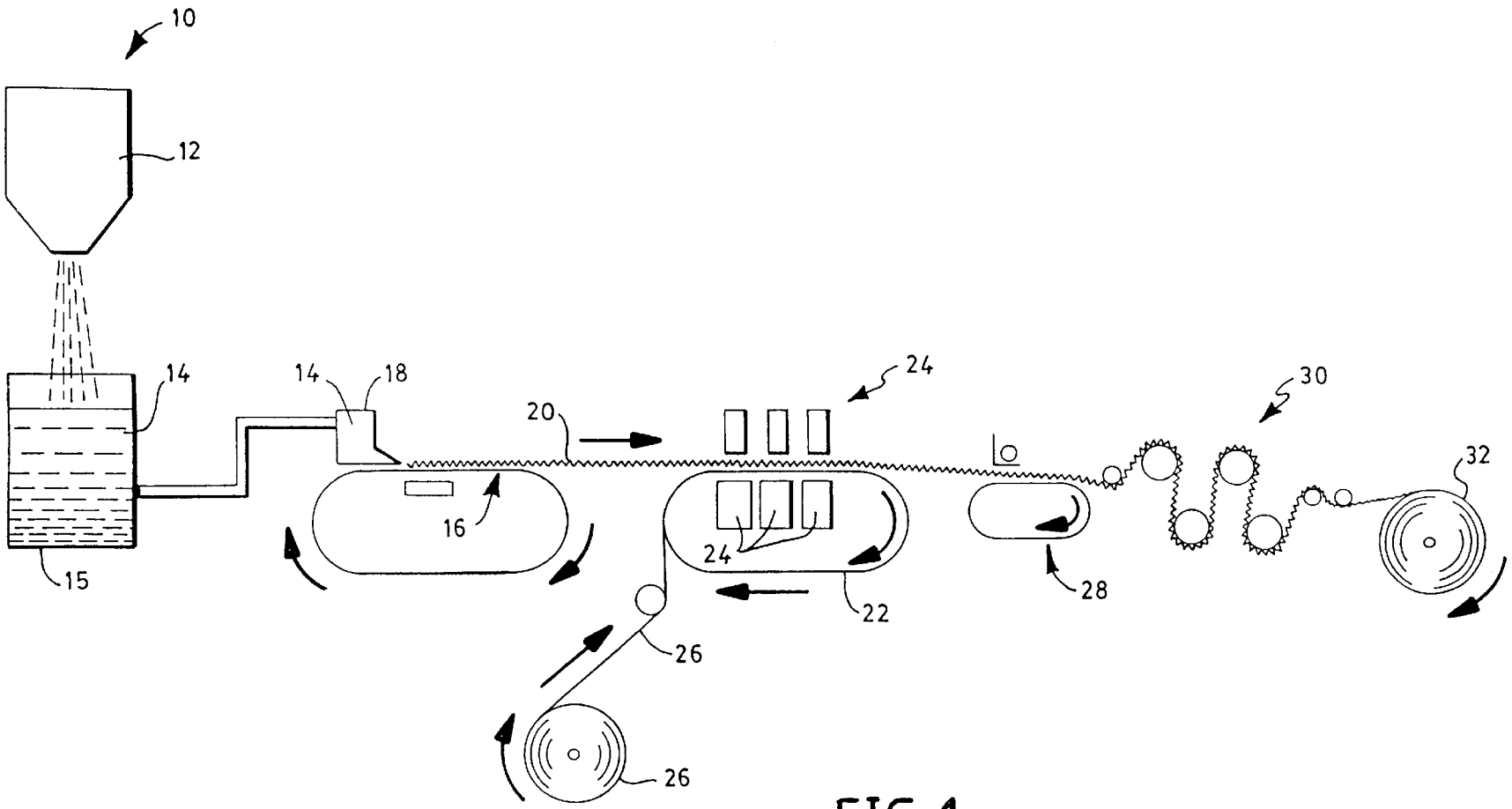
FIG. 1 is an illustration of an exemplary process for treating a fibrous material.

Referring now to FIG. 1, there is shown an illustration (not necessarily to scale) of an exemplary process for treating a fibrous material. Generally speaking, the treatment process may be incorporated imto the fiber preparation stage of a high speed wet-laying web forming operation that is coupled with a pressurized liquid let operation where unused or spent treatment and/or chemicals are washed from the fibrous material. For example, the treatment process can be incorporated into the pulping and stock preparation stage of a high-speed papermaking operation that is coupled with a hydraulic entangling or hydraulic neeadling operation where unused or spent treatment and/or chemicals are washed from the fibrous material. However, it should he understood that the present invention is not limited to such a configuration.

According to an embodiment of the present invention, a fibrous material 10 may be placed in a conventional papermaking fiber stock prep beater or pulper 12 containing a liquid (usually water). If the fibers are cellulosic in nature, the fibers may be refined in the beater or pulper until they are hydrated. The fibrous material stock is kept in continual agitation to form a liquid suspension.

A treatment is added to the fibrous material in the pulper or beater 12. If the fibrous material is cellulosic, the treatment is desirably added after the fibers are hydrated. The treatment may be in solid, liquid or gaseous form or combinations thereof. For example, the treatment may be in the form of pellets that dissolve in the liquid medium used to suspend the fibrous material. Alternatively and/or additionally, the treatment may be in form of a liquid added to or a gas that is blown into the liquid medium. The treatment may be composed of one or more components, reactants and/or phases added to the fibrous material at the same or at different times.

Generally speaking, the fibrous material is kept in continual agitation thus intermixing the liquid suspension of fibrous material and treatment. However, agitation may be stopped or used intermittently if excessive agitation would be harmful to the treatment or fibrous material. For example, agitation could be reduced if air entrained by agitation could oxidize or react with the treatment and reduce its effectiveness.

After fiber treatment (e.g., dyeing) within the pulper or beater 12, the suspension of fibrous material and intermixed treatment (e.g., stock slurry)is then diluted and readied for formation into a layer of fibrous material or web utilizing conventional wet-laying or papermaking techniques. The stock slurry 14 may be stored in a machine chest 15 prior to web forming. If desired, the stock slurry pH may be adjusted for equipment compatibility Fixatives and additives may be added at the pulper, machine chest, or immediately prior to forming. These material may be added to improve fastness and other properties such as softness and wet-strength. If desired, additional fibrous materials may be added. These materials may have had the same or different treatment. For example, these additional materials may have the same color or a different color. Examples of fibrous materials that may be added include wood furnishes, other cellulosic fibers, synthetic non-cellulosic wet forming staple fibers and the like.

These fibrous materials can be added to the stock slurry prior to forming the web to enhance strength, aesthetic, and durability properties. They can also be handled as separate slurry or slurries if one or more layers of different fiber types is desired.

Although non-cellulosic fibrous material (e.g., staple fibers) can be treated or dyed in a separate process, it is contemplated that they could be treated or dyed within the same system as the cellulosic fibrous material. For example, certain conventional vat dyes may be used to dye polyester fibrous material using thermofixing. Staple synthetic non-cellulosic fibers include polypropylene, polyester, nylon and polyethylene fibers.

The diluted aqueous suspension (e.g., stock slurry) 14 is conveyed and formed onto a moving foraminous forming wire 16 using a conventional papermaking headbox 18 or layering headbox with a forming section such as a Fourdrinier or incline wire. The incline wire generally being used to wet form relatively long fibers such as, for example, staple fibers. According to the present invention, high-speed papermaking machine web speeds of up to 2000 feet per minute (fpm) or more may be used. These speeds can be much greater than conventional continuous textile vat and reactive dye processes. Web speeds in such conventional textile process may reach up to 360 fpm utilizing improved festoon web pathways and washers.

After the aqueous suspension (e.g., stock slurry) is formed into a web 20 and sufficiently dewatered (typically at consistencies greater than 18% pressurized jets of a liquid are applied to the web while it is on the forming fabric. Alternatively, the web may be transferred to a different moving fabric 22 or moving drum (not shown) where pressurized jets of a liquid are applied utilizing a pressurized liquid jet forming apparatus such as, for example, conventional hydraulic entangling equipment 24.

Generally speaking, after treatments such as reactive or vat dyeing, the fibrous colored material must be washed to remove hydrolyzed and unfixed dye as well as spent chemicals. If this washing step is not done, fabric tendering, fastness, and color stability can be impaired. In addition, the washing step helps remove undesirable chemical residue that might present safety problems, problems for persons who have unprotected skin contact with the residue. Washing also helps minimize or eliminate undesirable wiping residue that could be caused by chemical left in the sheet. With most conventional textile fabric reactive and vat dye coloring systems, the washing step is necessary. A hot detergent bath is often used in the washing step of such conventional systems. However, these systems tend to be slow and are often performed in separate operations unconnected with the fabric forming process.

According to the present invention, unused, excess or exhausted treatment (e.g., dye chemical) may be effectively removed from the web/fibrous material by using pressurized jets of a liquid such as, for example, hydraulic entangling jets. This can be attributed to the high velocities and high volumes of liquid (typically water) employed. Effective washing is also due to individual treated fibers being thoroughly washed with the first hydraulic entangling manifolds while fibers are still loose and mobile before becoming impacted and entangled within the web's fiber matrix.

Warm soaps and detergents mav be incorporated into the pressurized liquid jets used to wash the webs. However, the high shear and washing action of the jets may be adequate to remove unused treatments so that soap/detergent washing is not needed. Utilizing such high pressure jets of liquid immediately after the formation of the web from a liquid suspension to wash the web can eliminate additional washing steps.

In an embodiment of the invention, hydraulic entangling or hydraulic needling steps are combined with the washing steps such that additional washing equipment and/or web consolidation equipment can be eliminated.

For example, the pressurized jets of a liquid may be adapted to hydraulically entangle the web. The hydraulic entangling may be accomplished utilizing conventional hydraulic entangling equipment 24 such as may be found in, for example, in U.S. Pat. No. 3,485,706 to Evans, the disclosure of which is hereby incorporated by reference. The hydraulic entangling of the present invention may be carried out with any appropriate working fluid such as, for example, water.

Alternatively, the pressurized jets of a liquid may be adapted to hydraulically needle the web. The hydraulic needling may be accomplished utilizing a process and equipment such as may be found in, for example, in U.S. Pat. No. 5,137,600, issued on Aug. 11, 1992, to Barnes et al., the disclosure of which is hereby incorporated by reference. The hydraulic needling of the present invention may be carried out with any appropriate working fluid such as, for example, water.

Aqueous suspensions of fibrous material and intermixed treatment may also be wet formed onto a substrate material such as, for example, a nonwoven web. In some cases, the substrate material is surfactant treated and partitioned vacuum dewatering zones employed. Treated fibrous material (e.g., colorfast fibers) and a pre-formed nonwoven synthetic web can be treated with pressurized jets of a liquid (e.g., hydraulically entangled) on the forming wire or downstream on another wire section or perforated drum.

Substrates such as, for example, woven and/or nonwoven webs 26 can also be readily added upstream of the hydraulic entangling equipment 24 after the layer of fibrous material or web 20 has been formed. Generally speaking, such techniques are disclosed in, for example, in U.S. Pat. No. 5,389,202 issued on Feb. 14, 1995, to Everhart et al., the disclosure of which is hereby incorporated by reference. Other layers may be added on top of the fibrous layer 20 to form a multi-layered (e.g., three or more layered) web. A wide variety of substrates is contemplated. For example, if the substrate is a nonwoven web, it can include continuous filaments such as spunbond and netting, meltblown, coform admixtures, carded and air formed staple fiber webs and combinations thereof. Such webs can be made of elastic or non-elastic spun polymers. Fibers and/or filaments can be made of thermoset or thermoplastic polymers.

Either one side or both sides of the materials may be treated with pressurized jets of a liquid. It is contemplated that the jets of liquid can be use to pattern the materials to produce cloth-like aesthetics using selective entangling backings.

Discharged water from the first pressurized liquid jet (e.g., hydraulic entangling) manifolds can be isolated from downstream manifolds since they are richer in washed-off treatments such as, for example, exhausted dye chemicals. Exhausted chemical and water can be treated and either reused within the process or cascaded in other on-site papermachine processes which require less stringent water conditions.

After the washing step, additional chemical and/or mechanical treatments 28 can be applied. For example, further washing or application of liquid treatments can accomplished by using, sprays, dip and squeeze techniques, vacuum extraction processes liouid curtains or the like. An example of a suitable process for applying liquid is disclosed at, for example, U.S. Pat. No. 5,486,381, entitled "Liquid Saturation Process" and issued on Jan. 23, 1996, to Cleveland et al., the contents of which are incorporated herein by reference.

Such equipment can also be used to add other types of chemicals or treatments including, for example, fixing agents. With the web washed of treatments such as, for example, exhausted dye, various fixing agents can be used at lower amounts than if introduced in the fiber stock prep stage (i.e., in the pulper or beater 12) to better fix the treatment since fugitive treatment has been washed from the fabric. For example, less dye fixing chemical may be required to fix dye molecules diffused into or bonded to individual fibers since excess or fugitive dye has been washed from the surface and interstices of the fibrous material.

Other chemicals can also be added including wet-strength resins, binders, brighteners, flame retardants, germicides, softeners, starches, corrosion inhibitors and a wide range of textile finishes. Citric acid and ethylene diamine can also be added to improve colorant fastness properties.

The treated and washed material may be dried. Through-air drying processes and can drying processes 30 have been found to work well. Other drying processes which incorporate infra-red radiation, yankee dryers, vacuum de-watering, microwaves, and ultrasonic energy may also be used. Thermal post-treatments may be used alone or in combination with the drying step to fuse a portion of any thermally fusable fibers that may be present in the material.

It may be desirable to use finishing steps and/or post treatment processes to impart selected properties to the material. For example, the material may be lightly pressed by calender rolls, creped or brushed to provide a uniform exterior appearance and/or certain tactile properties. Alternatively and/or additionally, chemical post-treatments such as, adhesives or dyes may be added to the fabric.

The material may also be wet or dry creped and/or mechanically softened via other methods to improve softness and hand or adhesive recreped to improve strength and bulk properties. Printed finishes may also be applied to improve aesthetics. Such processes can be inline prior to winding up the fabric onto a roll 32 or off-line.

A variety of fibrous materials may be used in the present invention. Generally speaking, the fibrous material should be able to withstand potentially aggressive or deleterious treatments such as, for example, reactive treatments or treatments requiring a relatively long exposure or residence time. Some fibers that may be used include, but are not limited to, pulp, cellulosic fibers including natural, synthetic and modified cellulose fibers, and polyester fibers, and combinations thereof.

Cellulose fiber sources for treatment (e.g., dyeing) include virgin wood fibers such as thermomechanical, bleached and unbleached softwood and hardwood pulps. Secondary or recycled fibers may be used. These fibers may be obtained from sources such as office waste, newsprint, brown paper stock, and paperboard scrap. Vegetable fibers can be used. These include hemp, abaca, flax, milkweed, cotton, modified cotton, and cotton linters. Svnthetic cellulosic fibers such as, for example, rayon and viscose rayon may also be used. Another exemplary type of synthetic cellulose is available under the trade designation "Lyocell" from Cortaulds. Modified cellulose fiber may also be used. For example, the fibrous material may be composed of derivatives of cellulose formed by substitution of appropriate radicals (e.g., carboxyl, alkyl, acetate, nitrate, etc.) for hydroxyl groups along the carbon chain. These fibers may be used alone, in combination with other cellulosic fibers and/or non-cellulosic fibers. Particulates and/or other materials may also be used with the fibrous materials.

When wood pulp (e.g., wood fibers) are used, stock consistencies of up to about 12% can readily be treated (e.g., dyed). After cellulosic fibers are fully hydrated, loose, and the fiber lumen swollen for accessibility, impregnation of a treatment (e.g., dye molecule) within the fiber structure is more fully and effectively accomplished. Less treatment (e.g., less dye) may be used under these conditions in comparison to conventional web treatments (e.g., web dyeing). Additional benefits may be realized if the treatment is a dye treatment. For example, in situations where excess dye is used to obtain deep levels of color, better incorporation of dye within the fiber produces better colorfastness.

Although the inventors should not be held to a particular theory of operation, the process of the present invention intermixes individual, agitated and freely suspended fibers with a treatment (e.g., a dye treatment). It is thought that more effective and thorough coloring may be obtained since migration of dye treatment/chemical into individual fibers is not impaired.

In contrast, fibers already fixed and embedded within a consolidated web are thought to impede migration of dye treatment/chemical into individual fibers. In addition, many treatments and dyes have strong affinity for cellulose which may make uniform penetration into fibers already fixed and embedded in consolidated webs rather difficult. The process of the present invention is thought to provide more uniform application of treatment than many conventional methods such as, for example, padding methods.

The fiber stock preparation step of the present invention allows control of long reaction times that may be needed for some treatments (e.g., to properly fix dye treatments) For example, reaction times typically greater than 60 seconds and often an hour or longer, may be realized. According to the present invention, temperature of the liquid suspension of fibrous material and intermixed treatment can also be controlled to facilitate optimum reaction kinetics.

The present invention contemplates a variety of treatments to fibrous materials. The treatments may interact with the fibrous material in many ways including, but not limited to, coating, reacting, diffusing and fixing. Multi-component treatments may be used. Treatments having several different reactants may also be used. In an aspect of the invention, the treatments will react with the surface of the fibrous material. In another aspect of the invention, the treatments may diffuse into the fibrous material and react with the fibrous material. In yet another aspect of the invention, the treatment may diffuse into the fibrous material or coat the surface of the fibrous material and then react with another component or agent of the treatment to fix the treatment in the fibrous material or on the fibrous material.

Exemplary treatments include acid treatments, caustic or base treatments, single and multicomponent reactants, reactive dyes and the like may be used, either alone or in combination. Certain types of dye treatments have been found to work well in the process of the present invention. For example, the process of the present invention may be used to dye fibrous material using reactive dyes, vat dyes or sulfur dyes.

Desirable treatments include reactive dyes. Generally speaking, these dyes are used with fibrous cellulosic materials. Although the inventors should not be held to a particular theory of operation, such dyes are generally thought to covalently bond to fiber. Reactive functional groups in the dyes are typically designed to react with cellulosic fiber often and preferably after diffusing into the fiber structure. These functional groups are designed to remain stable in and not react with the medium used for applying the dye. It is desirable that such dyes be able to function when water is used as the medium for applying the dye. Functional groups of these dyes may react with hydroxyl groups of cellulose to form cellulose ester fiber-dye covalent bonds that provide durable color.

Water hardness may require adjustment when these dyes are used in aqueous fiber handling systems. The level of adjustment may be readily determined by one of ordinary skill in the art. Reactive dyes are generally added to cellulosic fibers in the beater or pulper after hydration. An electrolyte salt such as, for example, magnesium sulfate or sodium chloride may be added. Generally speaking, the pH of the liquid suspension of fibers and intermixed reactive dye is raised to alkali levels to enhance reactivity between the dye and the fibers. For example, the ph may be raised to about 11 or 12. Alkali material such as, for example, soda ash (sodium hydroxide) or sodium bicarbonate may be used. Temperatures of the mixture of dye and fiber may be increased and held at elevated levels. Overall reaction time or period of time needed to adequately treat/dye the fiber ($T_R$) may range from less than 60 seconds to more than 120 minutes. Exemplary reactive dyes include Procion® H and M series (ICI Americas Inc.) and Cibacron® series (Ciba-Geigy). These dyes have desirable levels of solubility in water.

Reactive dyes have good light and wet fastness yet lack in bleachfastness. With use of secondary treatments after dyeing such as the use of urea, cationic fixing agents, and resins, modest improvements can be made. For many applications needing more stringent fastness requirements, vat dyes may be utilized.

When used with cellulosic fibrous material, vat dyes may be added to the beater or pulper after the fibrous material is hydrated. When aqueous suspensions of fibers are employed, vat dyes are typically water insoluble and must first be reduced to produce a water soluble form. This can be accomplished in the beater or pulper at conventional conditions. For example, consistencies of up to 12% may be used. Water hardness may be adjusted to improve water solubility of the vat dye. Sodium sulfate may be added to facilitate dye impregnation into cellulose fibers. The presence of calcium, magnesium, aluminum and similar polyvalent ions can negatively effect the solubility of a vat dye.

Generally speaking, vat dyes are converted from a water-insoluble form to a water-soluble "colorless" sodium-leuco form. This may be accomplished by adding an aqueous alkali solution of caustic soda (sodium hydroxide) and a reducing agent sodium hydrosulfite (sodium dithionite). The specific chemistry may vary with particular vat dyes but carrying out this step may be accomplished by one of ordinary skill in the art of vat dyeing.

After the vat dye is solubilized, the sodium-leuco form has good affinity for cellulose fibers and thus impregnates the fiber structure. If not in this form, there is little to no impregnation into fiber. Vat dyes tend to impregnate fiber less than other dyes so care must be taken in application to produce good fastness. Consistency of the fiber suspension, agitation, and dye, chemical, electrolyte concentrations and addition rates are variables that may require adjustment. Such adjustments can be made by one of ordinary skill in the art of vat dyeing. Improper addition can produce uneven coloring. If impregnation into fiber does not properly occur, when the leuco form is oxidized back to the insoluble pigment, the vat dye will simply wash out. Typical period of time or reaction times ($T_R$) for good dye impregnation and exhaustion in embodiments of the present invention are about 30–45 minutes. In some embodiments of the present invention, the time needed ($T_R$) for adequate treatment may be even shorter. For example, adequate treatment may be carried out over a time period of 10 minutes.

The water-soluble form of the vat dye which is impregnated in the fiber is then oxidized back to the water-insoluble form. This oxidation step is also a component of the period of time or reaction time ($T_R$) needed to treat the fibrous material. The oxidation reaction normally occurs simply by exposing the impregnated fiber to air and with continued agitation. Materials such as, for example, sodium perborate, sodium bichromate, and/or sodium or calcium hypochlorite may be added to reduce the oxidation reaction time. In some cases, an acid may be added to achieve high levels of oxidation.

Vat dyes may be classified into two categories: anthraquinonoid and indigoid dyes. Both may be used in the practice of the present invention. Examples of anthraquinonoid dyes include Cibanone® Dyes (Ciba-Geigy), Sandothrene® Dyes (Sandoz), and Caledon® Dyes (ICI). Indigoid dyes include Durindone® Dyes (ICI) and Ciba Blue 2B (Ciba-Geigy). Stable water soluble sulfate esters of leuco vat dyes may also be used.

EXAMPLES 1–15

Different reactive dyes, vat dyes and direct dyes were used to treat wood fibers. The dyes were used alone or in combination with fixative treatments. The dyes and fixative are available from the Ciba-Geigy Corporation, Basel, Switzerland. Specific Cibanone® series vat dyes, Cibacron® series reactive dyes, Pergasol® series cationic direct dyes and Tinofix® NF liquid fixative used in the examples are identified in Table 1.

Wood fiber furnish utilized for the dyeing studies was Terrace Bay Longlac 19, a bleached Northern softwood kraft pulp available from Kimberly-ClarK Corporation, Roswell, Ga.

Percentage amounts of formulations or recipes for vat dyes, reactive dyes and fixative treatments are based on pounds of ingredient per ton of wood fiber (i.e., lbs. of ingredient/2000 lbs. of wood fiber) where the wood fiber has an estimated 7% moisture content. The percentage amounts for other materials added are based on grams of ingredient per 100 grams of wood fiber or other furnish (i.e., gms. of ingredient/100 gms. wood fiber or other furnish). Reactions were typically carried out at ambient temperatures, under agitation, and water hardness was adjusted to approximately 100 PPM prior to dye addition unless noted. The specific amounts of material used in the formulations or recipes are identified for each example in Table 1.

General Procedure—Vat Dye

The wood fiber furnish was soaked in tap water to full hydration and pulped at approximately 3 percent consistency utilizing a laboratory blender. A caustic solution (e.g., NaOH solution) was added to the wood furnish. In general, sufficient caustic solution was added to adjust the pH to about 12. An electrolyte salt (e.g., sodium sulfate) was also added. The amount of electrolyte salt is listed in Table 1 for each example as a percentage based on pounds of ingredient per ton of wood fiber (i.e., lbs. of ingredient/2000 lbs. of wood fiber) where the wood fiber has an estimated 7% moisture content.

A vat dye was added to the wood furnish along with a reducing agent (e.g., sodium hydrosulfite) and agitated for a period of time. The amount is listed in Table 1 for each example as a percentage. Reaction time after the dye was added is listed in Table 1 for each example.

After a specified period of time in which the vat dye impregnated the hydrated cellulose, an oxidizing agent (e.g., sodium perborate) was added to the mixture under agitation. The amount is listed Table 1 for each example as a percentage. The agitation time after addition of the oxidizing agent is also listed in Table 1 for each example. After agitation, the mixture was immediately transferred to a stock chest where it was diluted to a consistency appropriate for conventional handsheet formation. The handsheets were washed and formed utilizing a conventional handsheet former and then hydraulically entangled.

General Procedure—Hydraulic Entangling

The wet-formed (wet-laid) web of dyed wood pulp was positioned on top of a relatively low basis weight, conventional polypropylene spunbond eeb. The basis weight of the spunbond web was approximately 17 gsm (~0.5 osy) and the basis weight of wet-formed treated pulp web was approximately 73 gsm (~2.2 osy) as determined from samples that were oven dried.

A conventional hydraulic entangling system composed of 3 manifolds was used. The basic operating procedure is described at, for example, U.S. Pat. No. 5,389,202, issued Feb. 14, 1995, to Everhart et al., the contents of which are incorporated herein by reference. Each manifold had an orifice size of 0.006 inch diameter. Orifices were positioned in a single row at a spacing of about 40 orifices per linear inch of manifold. Manifold water pressure was 850 psig which generated high energy fine columnar jets. The hydraulic entangling surface was a single layer 103AM polyester wire backing manufactured by Albany International, Portland, Tenn. The wood pulp and spunbonded webs were passed under the manifolds at a line speed of about 20 feet per minute (fpm) where they were washed and consolidated by the pressurized jets of water. The resulting composite material was dried utilizing a conventional laboratory handsheet dryer.

General Procedure—Direct Dye

A Pergasol Blue F3R solution was used to treat a hydraulically entangled wood/polypropylene spunbond substrate available as WORKHORSE® Manufactured Rags from Kimberly-Clark Corporation, Roswell, Ga. The wood fiber furnish employed is about 50% Longlac 19, 25% bleached Southern softwood kraft and 25% secondary fiber. The Pergasol Blue F3R solution was applied to the substrate utilizing a liquid weir arrangement as described in U.S. Pat. No. 5,486,381, entitled "Liquid Saturation Process" and issued on Jan. 23, 1996, to Cleveland et al., previously incorporated by reference.

Sample Testing

Substrate color levels were measured and recorded in Table 2 in CIELAB coordinates using a Hunter Lab Color Difference Meter, Model D25 Optical Sensor and manufactured by Hunter Associates Laboratory, Reston, Va. CIELAB coordinates are a system agreed upon in 1976 within the "Commission Internationale de l'Eclairage" or CIE. The coordinates are designated L*, a*, b*. The system uses a three axis opponent color scale assuming color is perceived in white to black (L*) or "lightness", green to red (a*), and yellow to blue (b*) sensations. L* varies from 100 for a perfect white to zero for a perfect black. a* measures redness when plus (i.e., positive), grey when zero, and greenness when minus (i.e., negative). b* measures yellowness when plus (i.e., positive), grey when zero, and blueness when minus (i.e., negative).

The CIELAB "Before Hydraulic Entangling Treatment (Before HET)" measurements were made using handsheets of the dyed wood furnish. "After Hydraulic Entangling Treatment (After HET)" measurements were made with the pulp side acting as the reflecting surface. The hydraulically entangled substrate contained white pigmented polypropylene spunbond fibrous web. The present invention is not limited to conventional hydraulic entangling treatment as a means to supply the pressurized jets of liquid to wash the fibrous material. It should be understood that hydraulic entangling treatment is an example of a type of pressurized liquid jet treatment that may be used.

Colorfastness or "fastness" of the materials produced in the Examples was tested to measured tendency of the color to fade or change upon exposure to bleach, vinegar, Formula 409 and an industrial solvent. These tests were conducted generally in accordance with AATCC Test Method 3-1989 and the I.S.O. Recommendation (International Organization for Standardization) as described in Trotman, E. R., Dyeing and Chemical Technology of Textile Fibres, 5th Edition, Charles Griffen & Co. Limited, Whitstable, Kent, England, 1975. A rating of "1–5" color change grading scale was used with "5" being the highest rating with negligible or no color chance to "1" being the lowest for large color change.

In each case, a test sample of approximately 1 sq. inch in size was soaked for a specified time in 100 mL of test solution/solvent and then dried at ambient conditions overnight. Test samples were compared to control samples.

Colorfastness upon exposure to household bleach (525% sodium hypochlorite) was studied at various concentrations of bleach. Test samples were soaked for 60 minutes with intermittent gentle agitation.

Distillate household vinegar (5% acidity) and Formula 409 (The Clorox Company, Oakland, Calif.) were used separately on samples to study colorfastness. Samples were soaked for 5 minutes in vinegar or Formula 409 without dilution.

Colorfastness upon exposure to an industrial solvent was studied using Autowash 6000—a printer's solvent available from Printers' Service, Newark, N.J. Autowash 6000 is composed of aliphatic and aromatic petroleum distillates and ethyleneoxy ethanol. Samples were soaked 5 minutes. The results of these tests are reported in Table 3.

Crock testing of substrates was performed on samples in both the dry state (See Table 2) and in the wet state (See Table 3) immediately after soaking in bleach, vinegar, Formula 409 or Autowash 6000 for the time specified above. The crock test determines the extent to which color may be transferred from the surface of a dyed fabric to another surface by rubbing (either while dry or while wetted with a specific liquid).

Testing was conducted utilizing an AATCC Crockmeter Model CM.5 manufactured by Atlas Electric Devices Co., Chicago, Ill. Each sample was approximately 4" wide×5½" long and was oriented along machine direction (i.e., along the direction of web formation) when mounted in the tester. A small cotton square cloth (2×2 Crockmeter squares, Part #12-2592-0000, Test Fabrics Inc., Middlesex, N.J.) was mounted on the peg of the crock tester. Tests were conducted for 30 cycles utilized (unless fabric damage occurred) and each sample was rated using the AATCC Chromatic Transference Scale, 1994 Edition, American Association of Textile Chemists and Colorists, Research Triangle Park, N.C. Grading was based on a "1–5" scale with "5" indicating no color transfer, "4" indicating pale color transfer, "3" indicating some color transfer, "2" indicating lots of color transfer and "1" indicating large color transfer. A rating of "3" or greater is considered acceptable for most applications.

RESULTS FOR EXAMPLES 1–15

As shown in Table 2, only a small amount of color loss (if any) was measured when dyed wood fibers were subjected to the high velocity hydraulic entangling jets which indicates sufficient fiber substantivity. This is observed by comparing CIELAB coordinates L*, a*, b* values "Before HET" to the "After HET" values. Color differences can be attributed in part to loss of unbonded and unreacted dye chemical, fine fiber loss through the hydraulic entangling wire backing and added white spunbond fibers/filaments causing lightening of the consolidated substrate.

A conventional spunbond polypropylene nonwoven web having a basis weight of about 17 gsm (about 0.5 osy) and identified as Example 15 served as a control material. Color measurement values are given as a reference for evaluating lightening of shade contribution due to white pigment added to the polypropylene used in manufacturing the spunbond nonwoven web. Similar polypropylene spunbond nonwoven web was hydraulically entangled with the treated (i.e., dyed) wood fibers as described above for Examples 1–13. The WORKHORSE® Manufactured Rag material of Example 14 also contained essentially identical polypropylene spunbond nonwoven web.

Table 2 shows that the samples had acceptable dry crock results. As can be seen in Table 3, some dyes have better chemical fastness to certain chemicals and not to others and rarely are equally fast to all. Examples 1 and 2 both have excellent colorfastness. Cibanone® Yellow 2G is included as a generally highly chemical fast colorant.

Different amounts of other vat dyes which might be less colorfast can be added as toners for different color shades of a highly fast colorant. In this way, overall fastness can be retained as snown by Example 3 where a pizza or salmon color is based on a highly fast yellow color.

As seen in the green shade Example 4, higher bleach concentrations (sodium hypochlorite) can negatively affect fastness. Addition of modest amounts of a fixing agent, Tinofix NF, to the stock prep vat dyeing process and a longer reaction time did not improve fastness nor crock resistance when comparing Examples 4 and 5. Adding fixing agents after the hydraulic entangling stage rather than during stock prep is expected to improve crock resistance.

Vat dyes similar in color can have improved fastness as can be seen, for example, in Example 6.

Blue vat colorants are difficult to make bleachfast (i.e., colorfast to bleach). Utilizing high levels of a fixing agent in the stock prep dyeing stage only modestly improved fastness as can be seen in a comparison of Examples 7, 8 and 9. By utilizing a combination of different colorfast vat dyes, a colorfast system could be produced. This is shown by combining Cibanone® Violet BNA DP (Example 10) and Cibanone® Olive B DP (Example 6) to produce a light blue which has improved fastness (Example 11) over Examples 7, 8 and 9 which are composed of only one type of vat colorant. A deep shade of blue could be obtained with vat dyes with reasonable fastness as shown in Example 12.

As seen in shown Example 13, the blue reactive dye overall colorant fastness was not as good as the vat dyes. For many applications, such fastness is acceptable.

Pergasol® Blue F 3R, a cationic direct dye, is part of a family of dyes which are commonly used in the paper industry for many applications. Such dyes fall short in many durable applications requiring high chemical resistance. Though Pergosal® Blue F 3R is highly fast to water at the given add-on levels of Example 14, it is highly sensitive to bleach and other chemicals as shown in Table 1.

EXAMPLE 16–29

General Procedure—Vat Dye

Wood pulp was treated generally in accordance with the procedure used for Examples 1–15. The wood fiber furnish was pulped at consistency noted for each example in fresh water or white water from previous runs utilizing a Voith Slushmaker Repulper. Certain conditions for each example are noted below and in Table 4. The general conditions used for Examples 1–15 including additional details provided in Examples 16 and 17 as well as Table 4 apply to the remaining Examples 18–29 except as given in the abbreviated notes below.

Examples 16 and 17 Pizza/Salmon—1

Step 1. 60 lbs.—Terrace Bay LL19 pulped at a 3.3% consistency (fresh water) using a Voith Slushmaker Repulper.

Step 2. 3 L NaOH (50% soln.)—agitate 30 sec.

Step 3. 20% Sodium Sulfate—(by wt., 400 lbs./ton) ~5446 grams. Continue agitation.

Step 4. Add Vat Dyes—Cibanone® Yellow 2G PST—(40 lbs./ton) ~545 gm and Cibanone® Red 6B PST, (10 lbs./ton) ~136 gm. Continue agitation.

Step 5. 10% Sodium Hydrosulfite (by wt.) ~2724 gm. pH=12.3. Agitated 2 mins. and stopped pulper. Remeasured pH=13.5. Color change occurred with reduction of dye.

Step 6. 40 mins. total reaction time with 30 secs. of agitation after 15 mins. of reaction, again repeated a second time. During the interim, the pulper was stopped.

Step 7. After 40 mins. pulper restarted, 7.5% Sodium Perborate added (by wt.) ~2043 gm. and pulper ran 20 mins. before dumping into stock chest for forming.

Step 8. Of the 60 lbs. of dyed stock, the tank was filled to the 103" mark (2880 gals.) (0.23 consistency) and then discharged, and diluted to a 0.17% consistency. This consistency was then utilized to form a web or layer of treated wood fibers.

Results: Crock testing results ranged from Ratings of "3" to "5" and are acceptable. See Table 5, Examples 16A through 17B. When the furnish is sandwiched between nonwozen spunbond webs, crock fastness improves.

The leucoform of the vat dye is a dark-colored purple shade. Tinofix® NF (a fixing agent) was added to the pressure jet treated material using a weir fluid distributor of the type described at, for example in U.S. Pat. No. 5,486,381, previously incorporated by reference. No improvement in fastness was noted.

Examples 18 and 19 Pizza/Salmon—2

Refer to Example 16 for General Dyeing Procedure. Changes are noted in specific Steps.

Step 1. Part of pulping water was make-up white water from Example 16.

Step 2. 1L NaOH (50% soln.) added. Lowered pH with hydrochloric and sulfuric acid. Remeasured pH=13.3.

Step 4. Add Cibanone® Yellow 2G PST—(60 lbs./ton), ~717 gm @0 reaction time. Cibanone® Red 6B PST—(151 lbs./ton) ~204 gm.

After 25 mins. of reaction, another 100 gms. of Cibanone® Yellow 2G was added and the reaction time was increased an additional 10 mins. for a total time of 50 mins.

Results: See Table 5.

Examples 20 and 21—Pizza/Salmon—4

Step 1. White water from prior run was used for repulping.

Step 2. 185 mL. NaOH (50% soln.). pH=12.5.

Step 3. 25% Sodium Sulfate (by wt.) –6810 gm.

Step 4. Add Cibanone® Yellow 2G PST (80 lbs./t)—1090 gm and Cibanone® Red 6B PST (20 lbs./t)—272 gms.

Results: See Table 5.

Examples 22 and 23—Orange—1

Step 1. Fresh water. 50:50 LL19/SSWK. (i.e., a fiber blend of equal parts LL19 Northern softwood kraft pulp and Southern softwood kraft pulp (SSWK)) 60 lbs. pulped 10 mins. @3.3% consistency.

Step 2. 3.5 L NaOH (50% soln.), pH=12.2

Step 3. 25% Sodium Sulfate—6810 gm.

Step 4. Add Cibanone® Orange 5G DP (33 lbs./t)—450 gm. and Cibanone® Red 2B PST (54 lbs./t)—735 gm.

Step 7. After 40 min reaction time, the pulper slurry was agitated 5 mins. to see if there was sufficient self-oxidation. Because of insufficient oxidation (no color change), 7.5% sodium perborate (2043 g) was added.

Results: The leucoform is a dark chocolate color. Furnish color level was acceptable. Crock fastness for the sandwiched fabric was acceptable with Ratings of 4 to 5. See Table 5.

Examples 24 and 25 Blue-Gray—1 (WSK-21)

Step 1. Fresh water. 60 lbs. of a 50:50 LL19/SSWK furnish.

Step 2. 2.5 L NaOH (50% soln.). pH=12.2.

Step 3. 25% Sodium Sulfate—6810 g.

Step 4. Add Cibanone® Orange 5G DP—136 g (10 lbs./ton), Cibanone® Navy PS PST—817 g (60 lbs./ton) and Cibanone® Blue GFJ DP—272 g (20 lbs./ton).

Results: See Table 5.

Examples 26, 27 and 28—Blue-Gray—2

Step 1. Fresh water. 60 lbs. of 50:50 LL19/SSWK furnish.

Step 2. 2.5 L NaOH (50% soln.), pH=12.3

Step 3. Cibanone® Orange 5G DP—82 g (6 lbs./ton), Cibanone® Navy PS PST—409 g (30 lbs./ton) and Cibanone® Blue GFJ DP—136 g (10 lbs./ton).

Results: Poor Crock and colorfastness results as shown in Table 5. A shift in color took place when the material was exposed to Formula 409.

Example 29—Light Blue (WSK-9)

Step 1. 60 lbs. furnish, 50:50 LL19/SSWK. Fresh water.

Step 2. 2.5 L NaOH (50% soln.) pH=12.3.

Step 3. 25% Sodium Sulfate—6810 g.

Step 4. Add Cibanone® Navy PS PST—68 g (5 lbs./ton) and Cibanone® Blue GFJ DP—109 g (8lbs./ton).

Results: See Table 5.

pH and Sulfate Testing

Materials from Examples 20–29 were cut into 10 inch by 10 inch square samples. Individual samples were soaked for 30 minutes in 200 mL of tap water at ambient temperature. After soaking, each sample was squeezed and rinsed with soak water through a wash ringer five times. The liquid in which an individual sample was soaked and the liquid squeezed from that sample was combined.

The pH of the liquid was measured with a conventional pH tester and the results are listed in Table 5. Sulfate levels in the liquid were tested utilizing a Hach DR/2000 Direct Reading Spectrophotomer and the Hach Sulfaver 4 Method (Turbidity Method). The results of the sulfate testing are reported in Table 5 in units of mg/L. As shown in Table 5, the pH levels were at or near neutral and the sulfate levels were between zero and about 3 mg/L indicating effective washing with the hydraulic entangling jets.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

TABLE 1

| EXAMPLE | DYE CLASS | DYE | COLOR | DYEING PROCEDURE | FIXATIVE |
|---|---|---|---|---|---|
| 1 | VAT | Cibanone Golden Yellow M PST. | Yellow | 30 lbs. Dye<br>6.25% Caustic (50% Soln.)<br>10% Sodium Sulfate<br>10% Sodium Hydrosulfite<br>20 Mins.<br>7.5% Sodium Perborate<br>10 Mins. | |
| 2 | VAT | Cibanone Yellow 2 G PST. | Yellow | 50 lbs Dye<br>Caustic (10% Soln.) to pH 12<br>20% Sodium Sulfate<br>10% Sodium Hydrosulfite<br>60 Mins.<br>7.5% Sodium Perborate<br>45 Mins.<br>Sulfuric Acid pH 7.5–8.5<br>Add Fixative<br>5 Mins. | 20 lbs Tinofix NF LIQ. |
| 3 | VAT | Cibanone Yellow 2G PST.<br>Cibanone Red 6B PST. | Pizza or Salmon | 40 lbs Yellow 2G +<br>10 lbs Red 6B<br>Caustic to pH 12<br>10% Sodium Sulfate<br>10% Sodium Hydrosulfite<br>20 Mins.<br>7.5% Sodium Perborate<br>10 Mins. | |
| 4 | VAT | Cibanone Green BFD LIQ. | Green | 30 lbs Dye<br>Caustic (10% soln.) to pH 12<br>10% Sodium Sulfate<br>10% Sodium Hydrosulfite<br>20 mins.<br>7.5% Sodium Perborate<br>10 mins. | |
| 5 | VAT | Cibanone Green BFD LIQ. | Green | 30 lbs Dye<br>Caustic Soda to pH 12<br>20% Sodium Sulfate<br>10% Sodium Hydrosulfite<br>60 Mins.<br>7.5% Sodium Perbrate<br>45 Mins.<br>Sulfuric Acid to pH 7.5–8.5<br>Add Fixative<br>5 Mins. | 20 lbs. Tinofix NF LIQ. |
| 6 | VAT | Cibanone Olive B DP. | Olive Green | 15 lbs Dye<br>Caustic to pH 12.0<br>20% Sodium Sulfate<br>10% Sodium Hydrosulfite<br>40 Mins.<br>7.5% Sodium Perborate<br>30 Mins.<br>Sulfuric Acid to pH 7.5–8.5 | |
| 7 | VAT | Cibanone Blue 2B PST. | Blue | 50 lbs Dye<br>Caustic to pH 12<br>20% Sodium Sulfate<br>10% Sodium Hydrosulfite<br>20 Mins.<br>7.5% Sodium Perborate<br>10 Mins. | |

TABLE 1-continued

| EXAMPLE | DYE CLASS | DYE | COLOR | DYEING PROCEDURE | FIXATIVE |
|---|---|---|---|---|---|
| 8 | VAT | Cibanone Blue 2B PST | Blue | 40 lbs Dye<br>Caustic to pH 12<br>20% Sodium Sulfate<br>10% Sodium Hydrosulfite<br>60 Mins.<br>7.5% Sodium Perborate<br>45 Mins.<br>Sulfuric Acid to pH 7.5–8.5 | 40 lbs. Tinofix NF LIQ. |
| 9 | VAT | Cibanone Blue 2 B PST. | Blue | 40 lbs. Dye<br>Caustic Soda to pH 12<br>10% Sodium Sulfate<br>10% Sodium Hydrosulfite<br>20 Mins.<br>7.5% Sodium Perborate<br>Fixative | 80 lbs. Tinofix NF LIQ. |
| 10 | VAT | Cibanone Violet BNA DP. | Violet | 10 lbs Dye<br>Caustic to pH 12<br>20% Sodium Sulfate<br>10% Sodium Hydrosulfite<br>40 Mins.<br>7.5% Sodium Perborate<br>30 Mins. | |
| 11 | VAT | Cibanone Violet BNA DP.<br>Cibanone Olive B DP. | Light Blue | 7.5 lbs Violet BNA DP. Plus 5.0 lbs Olive B DP.<br>Caustic to pH 12<br>20% Sodium Sulfate<br>10% Sodium Hydrosulfite<br>40 Mins.<br>7.5% Sodium Perborate<br>30 Mins.<br>Sulfuric Acid to pH 7.5–8.5 | |
| 12 | VAT | Cibanone Blue 2B MTG | Blue | 100 lbs Dye<br>Caustic to pH 12<br>25% Sodium Sulfate<br>15% Sodium Hydrosulfite<br>90 Mins.<br>7.5% Sodium Perborate<br>20 Mins. | |

TABLE 1-continued

| EXAMPLE | DYE CLASS | DYE | COLOR | DYEING PROCEDURE | FIXATIVE |
|---|---|---|---|---|---|
| 13 | REACTIVE | Cibanone Blue CR Liq 33 | Blue | Water Hardness 180 ppm<br>110 lbs Dye<br>25% Magnesium Sulfate<br>90 Mins.<br>Caustic to pH 11–12<br>20 Mins. | |
| 14 | CATIONIC DIRECT | Pergasol Blue F 3R | Blue | 0.5% Solution HYDROKNIT ® Material | |
| 15 | CONTROL | | White | Spunbond Polypropylene | |

TABLE 2

| Example | Color Level — CIELAB Before HET L* | a* | b* | After HET L* | a* | b* | DRY CROCK Rating |
|---|---|---|---|---|---|---|---|
| 1 | 82.50 | 4.61 | 55.18 | 85.87 | 10.75 | 56.59 | 5 |
| 2 | 86.28 | 0.05 | 45.93 | 87.00 | −2.04 | 48.46 | 5 |
| 3 | | | | 69.09 | 23.47 | 24.42 | 5 |
| 4 | 70.26 | −25.67 | −5.08 | 75.64 | −23.84 | −7.19 | 5 |
| 5 | 67.03 | −27.55 | −6.28 | 66.06 | −27.71 | −8.59 | 4 |
| 6 | 62.99 | −10.43 | 3.76 | 67.45 | −10.84 | 3.62 | 5 |
| 7 | 58.38 | 0.13 | −28.59 | 52.64 | 2.45 | −31.79 | 4 |
| 8 | 53.16 | −1.27 | −26.84 | 55.36 | −0.11 | −27.49 | 4 |
| 9 | 59.67 | 0.96 | −22.98 | 63.88 | −0.18 | −21.06 | 4 |
| 10 | | | | 70.50 | 11.07 | −15.67 | 5 |
| 11 | | | | 72.71 | −0.73 | −12.42 | 5 |
| 12 | 53.82 | 0.02 | −29.37 | 50.12 | 0.73 | −30.89 | 5 |
| 13 | 48.76 | 2.01 | −30.11 | 52.85 | 1.83 | −30.41 | 3 |
| 14 | | | | 71.61 | 0.54 | −25.03 | 3 |
| 15 | 97.65 | 1.41 | 4.39 | | | | 5 |

TABLE 3

| Example | Concentration % | Soak Time Mins. | Bleach Fastness Rating | Bleach Crock Resistance Rating | Vinegar Fastness Rating | Vinegar Crock Resistance Rating | Formula 409 Fastness Rating | Formula 409 Crock Resistance Rating | Prisco Autowash 6000 Fastness Rating | Prisco Autowash 6000 Crock Resistance Rating |
|---|---|---|---|---|---|---|---|---|---|---|
| 1 | 5.25 | 60 | 4 | 5 | 4 | 4 | 5 | 4 | 5 | 4 |
| 2 | 5.25 | 60 | 5 | 3 | 5 | 3 | 5 | 4 | 5 | 4 |

TABLE 3-continued

| | | | Bleach | | Vinegar | | Formula 409 | | Prisco Autowash 6000 | |
|---|---|---|---|---|---|---|---|---|---|---|
| Example | Concen-tration % | Soak Time Mins. | Fastness Rating | Crock Resistance Rating | Fastness Rating | Crock Resistance Rating | Fastness Rating | Crock Resistance Rating | Fastness Rating | Crock Resistance Rating |
| 3 | 5.25 | 60 | 5 | 5 | 5 | 3 | 5 | 5 | 4 | 3 |
| 4 | 5.25 | 60 | 4 | 3 | 5 | 4 | 5 | 3 | 3 | 4 |
| | 1.5 | 60 | 5 | | | | | | | |
| | 0.3 | 60 | 5 | 3 | | | | | | |
| 5 | 5.25 | 60 | 4 | 5 | 5 | 3 | 5 | 3 | 4 | 3 |
| 6 | 5.25 | 90 | 5 | 4 | 5 | 4 | 5 | 3 | 4 | 4 |
| 7 | 5.25 | 60 | 1 | | 5 | 2 | 4 | 3 | 4 | 3 |
| 8 | 5.25 | 60 | 2 | 4 | 5 | 2 | 5 | 3 | 4 | 2 |
| 9 | 5.25 | 60 | 3 | 5 | 5 | 2 | 5 | 2 | 4 | 2 |
| | 1.5 | 60 | 3 | | | | | | | |
| | 0.3 | 60 | 3 | | | | | | | |
| 10 | 5.25 | 60 | 5 | 4 | 5 | 4 | 5 | 5 | 4 | 4 |
| 11 | 5.25 | 60 | 5 | 5 | 5 | 4 | 5 | 4 | 5 | 4 |
| 12 | 5.25 | 60 | 2 | 5 | 5 | 2 | 4 | | 3 | 2 |
| | 1.5 | 60 | 3 | | | | | | | |
| | 0.3 | 60 | 3 | | | | | | | |
| 13 | 5.25 | 60 | 3 | 5 | 4 | 2 | 4 | 1 | 3 | 2 |
| 14 | 5.25 | 60 | 1 | 4 | 5 | 3 | 5 | 2 | 4 | 2 |

TABLE 4

| Example No. | Color | % Conc. TINOFIX in Weir | Furnish | Polypropylene SB Basis Weight[1] | Plies SB | Pulp BW GSM | # of sides treated | Manifold Pressure (psig) | Line SPEED FPM |
|---|---|---|---|---|---|---|---|---|---|
| 16 | Pizza | 0 | 100% LL19 | 1.0 osy | 2 | 158 | 2 | 1700 | 16.5 |
| 17 | Pizza | 3 | 100% LL19 | | | | | | |
| 18 | Pizza | 0 | 100% LL19 | 0.4 osy | 1 | 72 | 1 | 850 | 36 |
| 19 | Pizza | 3 | 100% LL19 | 0.4 osy | | | | | |
| 20 | Orange | 0 | 50% LL19/50% SSWK[2] | 0.7 osy | 2 | 125 | 2 | 1700 | 15.6 |
| 21 | Orange | 3 | 50% LL19/50% SSWK | | | | | | |
| 22 | Orange | 0 | 50% LL19/50% SSWK | 0.4 osy | 1 | 72 | 1 | 850 | 27 |
| 23 | Orange | 3 | 50% LL19/50% SSWK | | | | | | 25 |
| 24 | Blue Gray | 0 | 50% LL19/50% SSWK | 0.4 osy | 1 | 72 | 1 | 850 | 21.2 |
| 25 | Blue Gray | 3 | 50% LL19/50% SSWK | | | | | | |
| 26 | Blue Gray | 0 | | 0.4 osy | 1 | 72 | 1 | 850 | 21.2 |
| 27 | Blue Gray | 0 | 50% LL19/50% SSWK | 0.7 osy | 2 | 125 | 2 | 1700 | 15 |
| 28 | Blue Gray | 3 | 50% LL19/50% SSWK | | | | | | |
| 29 | Light Blue | 0 | 50% LL19/50% SSWK | 0.4 osy | 2 | 63 | 2 | 1200 | 30.4 |

[1]basis weight of each ply.
[2]Southern softwood kraft pulp

TABLE 5

| Example | Side | CROCK TESTING Dry | Bleach | Vinegar | Formula 409 | Auto Wash 6000 | pH | Sulfate mg/L |
|---|---|---|---|---|---|---|---|---|
| 16 | A—Pulp | 5 | 4.5 | 5 | 4 | 5 | | |
| 16 | B—Spunbond | 5 | 4.5 | 4.5 | 4 | 4.5 | | |
| 17 | A—Pulp | 5 | 4.5 | 5 | 4 | 5 | | |
| 17 | B—Spunbond | 5 | 4.5 | 4.5 | 4.5 | 4.5 | | |
| 18 | A—Pulp | 4 | 3 | 3.5 | 3.5 | 4 | | |
| 18 | B—Spunbond | 4.5 | 4 | 4 | 4 | 4.5 | | |
| 19 | A—Pulp | 4.5 | 3 | 3 | 3 | 4 | | |
| 19 | B—Spunbond | 4 | 4 | 4 | 4 | 4 | | |
| 20 | A—Pulp | 5 | 4 | 4 | 4.5 | 5 | 7.1 | 2.5 |
| 20 | B—Spunbond | 5 | 4.5 | 4 | 5 | 5 | | |
| 21 | A—Pulp | 5 | 4 | 4.5 | 4 | 5 | 6.45 | 2 |
| 21 | B—Spunbond | 5 | 4 | 5 | 4 | 5 | | |
| 22 | A—Pulp | 4 | 3 | 3.5 | 3 | 3.5 | 7.25 | 3 |
| 22 | B—Spunbond | 4 | 3.5 | 3 | 3 | 5 | | |
| 23 | A—Pulp | 5 | 2 | 2 | 2 | 4 | 6.9 | 2.5 |
| 23 | B—Spunbond | 5 | 2 | 3 | 3.5 | 4.5 | | |
| 24 | A—Pulp | 4 | 1 | 1 | 2 | 4 | 7.2 | 3 |
| 24 | B—Spunbond | 4 | 2 | 2.5 | 2 | 5 | | |
| 25 | A—Pulp | 5 | 1 | 2 | 1 | 4.5 | 6.8 | 0 |
| 25 | B—Spunbond | 5 | 2.5 | 3 | 2 | 5 | | |
| 26 | A—Pulp | 3 | 1 | 1 | 1 | 3.5 | 7.25 | 0.5 |
| 26 | B—Spunbond | 3.5 | 1 | 2 | 1 | 3.5 | | |
| 27 | A—Pulp | 5 | 4 | 4.5 | 5 | 5 | 7 | 0 |
| 27 | B—Spunbond | 5 | 4 | 4 | 5 | 5 | | |
| 28 | A—Pulp | 5 | 4 | 4 | 2 | 5 | 6.5 | 2.5 |
| 28 | B—Spunbond | 5 | 3.5 | 3 | 3 | 5 | | |
| 29 | A—Pulp | 5 | 4 | 4.5 | 4 | 5 | 7.25 | 0.5 |
| 29 | B—Spunbond | 5 | 4 | 4 | 5 | 4.5 | | |

What is claimed is:

1. A process for treating a fibrous material comprising:

providing a liquid suspension comprising fibrous material;

providing a chemically reactive treatment requiring a period of time $T_R$ sufficient to react with and treat the fibrous material;

intermixing the liquid suspension of fibrous material with the treatment over a time period $T_1$;

depositing the liquid suspension of fibrous material and intermixed treatment onto a forming surface to form a layer and removing a substantial portion of the liquid, over a period of time $T_2$; and applying pressurized jets of a liquid to the layer of fibrous material to wash unused, unreacted treatment from the fibrous material within a period of time $T_3$ and to hydraulically entangle the fibrous material to form a coherent web;

wherein $T_1$, $T_2$ and $T_3$ are immediately consecutive and amount to a period of time at least as great as $T_R$.

2. The process of claim 1 wherein the liquid suspension of fibrous material is an aqueous suspension of hydrated cellulosic fibers.

3. The process of claim 1 wherein the deposited layer of fibrous material and intermixed treatment is a web.

4. The process of claim 1 wherein the deposited layer of fibrous material and intermixed treatment is combined with at least one other layer of sheet material prior to application of pressurized jets of a liquid.

5. The process of claim 4 wherein the at least one layer of sheet material is selected from nonwoven webs, textile webs, scrim materials, plexifilimentary films, tows and combinations the same.

6. The process of claim 1 wherein the layer is hydraulically needled.

7. The process of claim 1 further including at least one post treatment step.

8. A process for forming a web of treated fibrous cellulosic material comprising:

providing an aqueous suspension comprising hydrated fibrous cellulosic material;

providing a chemically reactive treatment requiring a period of time $T_R$ sufficient to react with and treat the fibrous cellulosic material;

intermixing the aqueous suspension of hydrated fibrous cellulosic material with the reactive treatment over a time period $T_1$;

depositing the aqueous suspension of hydrated fibrous cellulosic material and intermixed reactive treatment onto a surface to form a web and removing a substantial portion of the aqueous liquid, over a period of time $T_2$; and applying pressurized jets of a liquid to the web to wash unused, unreacted reactive treatment from the web within a period of time $T_3$ and to hydraulically entangle the web;

wherein $T_1$, $T_2$ and $T_3$ are immediately consecutive and amount to a period of time at least as great as $T_R$.

9. The process of claim 8 wherein the deposited layer of fibrous material and intermixed treatment is combined with at least one other layer of sheet material prior to application of pressurized jets of a liquid.

10. The process of claim 8 wherein the forming surface includes at least one layer of sheet material between the forming surface and the deposited layer of fibrous material and intermixed treatment.

11. The process of claim 10 wherein the at least one layer of sheet material is selected from nonwoven webs, textile webs, scrim materials, plexifilimentary films, tows and combinations of the same.

12. The process of claim 11 wherein the nonwoven webs are selected from meltblown webs, spunbond webs, bonded carded webs, fibrous batts, air-laid webs, wet-laid webs, coformed webs and combinations thereof.

13. The process of claim 8 wherein the web is hydraulically needled.

14. The process of claim 8 wherein the fibrous cellulosic material is selected from pulp fibers, synthetic cellulose fibers and combinations thereof.

15. The process of claim 8 further including at least one post treatment step.

16. A process for forming a web comprising:

providing a liquid suspension comprising fibrous material;

providing a chemically reactive treatment requiring a period of time $T_R$ sufficient to react with and treat the fibrous material;

intermixing the liquid suspension of fibrous material with the reactive treatment over a time period $T_1$;

depositing the liquid suspension of fibrous material and intermixed reactive treatment onto at least one layer of sheet material to form a web and removing a substantial portion of the liquid, over a period of time $T_2$; and applying pressurized jets of a liquid to the web to wash unused, unreacted reactive treatment from the web within a period of time $T_3$ and to hydraulically entangle the web with the sheet material;

wherein $T_1$, $T_2$ and $T_3$ are immediately consecutive and amount to a period of time at least as great as $T_R$.

17. The process of claim 16 wherein the liquid suspension of fibrous material is an aqueous suspension of hydrated cellulosic fibers.

18. The process of claim 16 wherein the at least one layer of sheet material is selected from nonwoven webs, textile webs, scrim materials, plexifilimentary films, tows and combinations of the same.

19. The process of claim 18 wherein the nonwoven webs are selected from meltblown webs, spunbond webs, bonded carded webs, fibrous batts, air-laid webs, wet-laid webs, coformed webs and combinations thereof.

20. The process of claim 16 further comprising positioning at least one additional layer of sheet material over the fibrous material and intermixed reactive treatment prior to applying the pressurized jets of the liquid.

* * * * *